US008087765B2

(12) United States Patent
Takagi

(10) Patent No.: US 8,087,765 B2
(45) Date of Patent: Jan. 3, 2012

(54) INK SUPPLY SYSTEMS

(75) Inventor: Yuki Takagi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 538 days.

(21) Appl. No.: 12/325,949

(22) Filed: Dec. 1, 2008

(65) Prior Publication Data

US 2009/0141102 A1 Jun. 4, 2009

(30) Foreign Application Priority Data

Nov. 30, 2007 (JP) ..... 2007-311812

(51) Int. Cl.
*B41J 2/175* (2006.01)

(52) U.S. Cl. ..... 347/86; 347/85; 347/87

(58) Field of Classification Search ..... 347/85–87
See application file for complete search history.

(56) References Cited

U.S. PATENT DOCUMENTS

| | | | | |
|---|---|---|---|---|
| 4,700,202 | A * | 10/1987 | Kuranishi et al. | 347/86 |
| 5,500,663 | A * | 3/1996 | Ujita et al. | 347/86 |
| 5,589,862 | A * | 12/1996 | Ujita et al. | 347/87 |
| 5,838,352 | A * | 11/1998 | Martinez | 347/87 |
| 6,048,055 | A | 4/2000 | Hakkaku | |
| 6,273,151 | B1 * | 8/2001 | Kong | 141/18 |
| 6,296,353 | B1 | 10/2001 | Thielman et al. | |
| 6,505,923 | B1 | 1/2003 | Yamamoto et al. | |
| 7,192,126 | B2 * | 3/2007 | Hilton et al. | 347/85 |
| 2004/0145635 | A1 * | 7/2004 | Ebisawa et al. | 347/85 |
| 2004/0174417 | A1 | 9/2004 | Kobayashi et al. | |
| 2006/0192809 | A1 * | 8/2006 | Nakashima | 347/22 |
| 2006/0232648 | A1 * | 10/2006 | Aruga | 347/86 |
| 2006/0244792 | A1 * | 11/2006 | Tanaka | 347/85 |
| 2007/0070151 | A1 | 3/2007 | Hattori et al. | |

FOREIGN PATENT DOCUMENTS

| | | | |
|---|---|---|---|
| EP | 0562717 | A1 | 9/1993 |
| EP | 0945271 | A2 | 9/1999 |
| EP | 1541359 | A1 | 6/2005 |
| EP | 1557272 | A2 | 7/2005 |
| JP | 2007196647 | A | 12/2008 |

OTHER PUBLICATIONS

The State Intellectual Property Office of the People'S Republic of China; Notification of First Office Action in Chinese Patent Application No. 200810177431.X (counterpart to the above-captioned US Patent Application) mailed on Jun. 9, 2010.

European Patent Office, European Search Report for Related EP Application No. 08003703 dated Jul. 3, 2008.

* cited by examiner

*Primary Examiner* — Ellen Kim
(74) *Attorney, Agent, or Firm* — Baker Botts L.L.P.

(57) ABSTRACT

An ink supply system includes an ink cartridge and a cartridge mounting portion. The ink cartridge includes an ink chamber, and a tube having a first opening and a second opening formed therein. The first opening extends from a first end of the tube, and the second opening extends from a second end of the tube opposite the first end of the tube. The first opening is configured to be in fluid communication with the ink chamber via the first end of the tube, and the second opening is configured to be in fluid communication with an exterior of the tube via the second opening of the tube. The cartridge mounting portion includes a projection configured to be inserted into the second opening of the tube via the second end of the tube. A diameter of the second opening is less than an outer diameter of the projection.

15 Claims, 11 Drawing Sheets

INK SUPPLY SYSTEMS

CROSS-REFERENCE TO RELATED APPLICATION

The present application claims priority from Japanese Patent Application No. JP-2007-311812, which was filed on Nov. 30, 2007, the disclosure of which is incorporated herein by reference in its entirety.

BACKGROUND OF THE INVENTION

1. Field of the Invention

The present invention relates generally to ink supply systems comprising an ink cartridge and a cartridge mounting portion configured to receive the ink cartridge.

2. Description of Related Art

A known inkjet printer, such as the inkjet printer described in JP-A-2007-196647, has an ink supply system. The ink supply system has an ink cartridge having an ink chamber, and a cartridge mounting portion configured to removably receive the ink cartridge. When the ink cartridge is mounted to the cartridge mounting portion, an ink path is formed extending from the ink chamber to a recording head of the inkjet printer. Ink is supplied from the ink chamber to the recording head via the ink path. The ink cartridge has an air introduction portion configured to introduce air into the ink chamber. The air introduction portion has an opening formed through a wall of the ink cartridge, an elastic tube positioned at the periphery of the opening, and a valve configured to selectively cover and uncover the opening. The valve has a rod, and the rod is positioned in the tube. When the ink cartridge is mounted to the cartridge mounting portion, the rod contacts an inner wall of the cartridge mounting portion and is pushed toward the ink chamber, such that the valve is moved and the opening is uncovered. When this occurs, the tube is pressed against the inside wall of the cartridge mounting portion, such that the interior of the tube is sealed from the exterior of the tube. The inner wall of the cartridge mounting portion has a passage formed therethrough, such that, the interior of the ink chamber is in communication with the exterior of the ink chamber via the tube of the ink cartridge and the passage of the inner wall in the cartridge mounting portion.

Nevertheless, the tube may not be pressed evenly against the inner wall of the cartridge mounting portion. Consequently, a gap may be formed between the inner wall and the tube. The printer may not operate properly, and a user may return the printer to a store which sold the printer or to a manufacturer of the printer with the ink cartridge still mounted to the cartridge mounting portion. In such a case, ink may leak via the gap between the inner wall and the tube, and the ink may smear the interior of the printer when the printer is returned to the store or the manufacturer.

SUMMARY OF THE INVENTION

Therefore, a need has arisen for ink supply systems which overcome these and other shortcomings of the related art. A technical advantage of the present invention is that a reliable seal is provided at a predetermined portion of an ink cartridge, and the predetermined portion is configured to introduce air into the ink cartridge.

According to an embodiment of the present invention, an ink supply system comprises an ink cartridge and a cartridge mounting portion configured to receive the ink cartridge. The ink cartridge comprises an ink chamber configured to store ink, and a tube having a first opening and a second opening formed therein. The second opening is continuous with the first opening. The first opening extends from a first end of the tube, and the second opening extends from a second end of the tube opposite the first end of the tube. The first opening is configured to be in fluid communication with the ink chamber via the first end of the tube, and the second opening is configured to be in fluid communication with an exterior of the tube via the second opening of the tube. The cartridge mounting portion comprises a projection configured to be inserted into the second opening of the tube via the second end of the tube when the ink cartridge is mounted to the cartridge mounting portion. A diameter of the second opening is less than an outer diameter of the projection.

According to another embodiment of the present invention, an ink supply system comprises an ink cartridge and a cartridge mounting portion configured to receive the ink cartridge. The ink cartridge comprises an ink chamber configured to store ink, and a tube having an opening formed therein. The opening extends from a first end of the tube to a second end of the tube opposite the first end of the tube. The opening is configured to be in fluid communication with the ink chamber via the first end of the tube, and to be in fluid communication with an exterior of the tube via the second opening of the tube. The cartridge mounting portion comprises a projection configured to be inserted into the opening of the tube via the second end of the tube when the ink cartridge is mounted to the cartridge mounting portion. A diameter of the opening is less than an outer diameter of the projection.

Other objects, features, and advantages of embodiments of the present invention will be apparent to persons of ordinary skill in the art from the following description of preferred embodiments with reference to the accompanying drawings.

BRIEF DESCRIPTION OF DRAWINGS

For a more complete understanding of the present invention, the needs satisfied thereby, and the objects, features, and advantages thereof, reference now is made to the following description taken in connection with the accompanying drawings.

DETAILED DESCRIPTION OF EMBODIMENTS

Embodiments of the present invention and their features and technical advantages may be understood by referring to FIGS. 1-11, like numerals being used for like corresponding portions in the various drawings.

Figure 1:
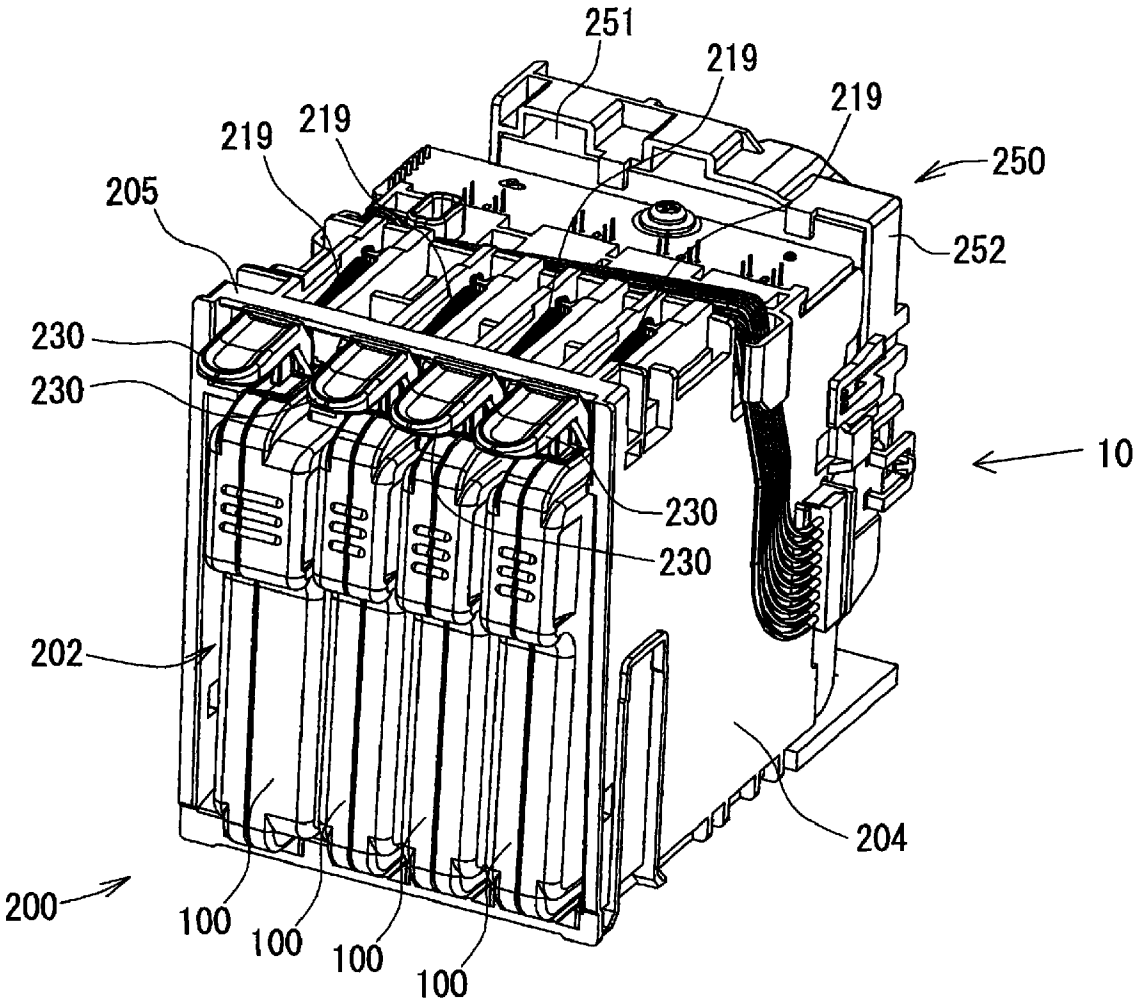
FIG. 1 is a perspective view of an ink supply system, according to an embodiment of the present invention.

Referring to FIG. 1, an ink supply system 10 according to an embodiment of the present invention may comprise at least one ink cartridge 100, e.g., four ink cartridges 100, and a cartridge mounting portion 200 configured to removably receive the ink cartridges 100. The ink supply system 10 may be configured to be used in an image forming apparatus, such as an inkjet printer, and the ink supply system 100 may be configured to supply ink stored in the ink cartridges 100 to a recording head of the image forming apparatus.

Referring to FIGS. 2(A)-3(B), ink cartridge 100 may have a rectangular, parallelepiped shape having a width in a width direction 31, a height in a height direction 32, and a depth in a depth direction 33. The width may be less than each of the height and the depth. Ink cartridge 100 may be configured to be inserted into cartridge mounting portion 200 in an insertion direction 30, which may be parallel to depth direction 33. When ink cartridge 100 is mounted to cartridge mounting portion 200, a surface of ink cartridge 100 positioned at the top of ink cartridge 100 in FIGS. 2(A)-3(B) may be positioned above another surface of ink cartridge 100 positioned at the bottom of the ink cartridge 100 in FIGS. 2(A)-3(B).

Figure 2B:
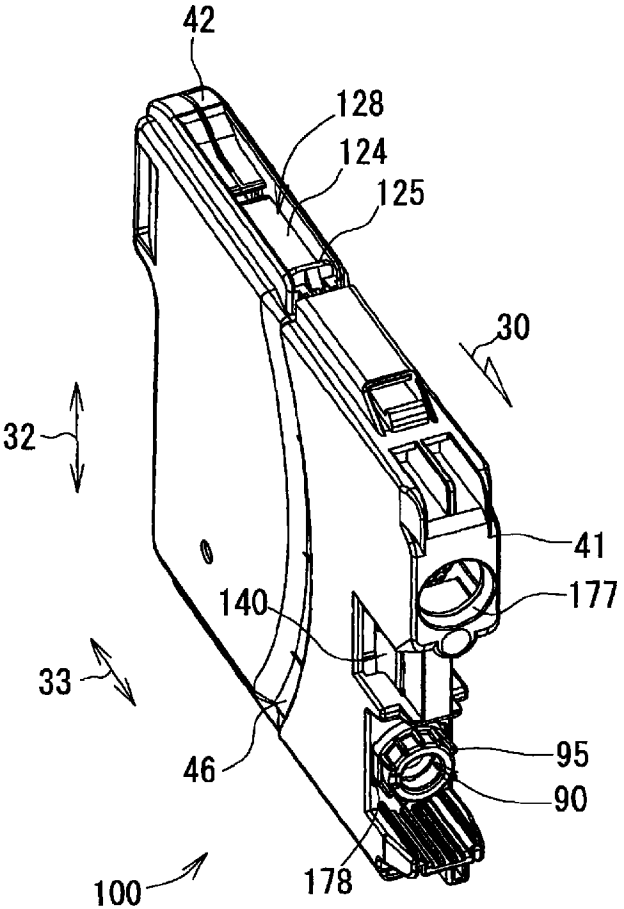
FIG. 2(B) is a perspective view of the ink cartridge in which the slider is in a second position.
Figure 2A:
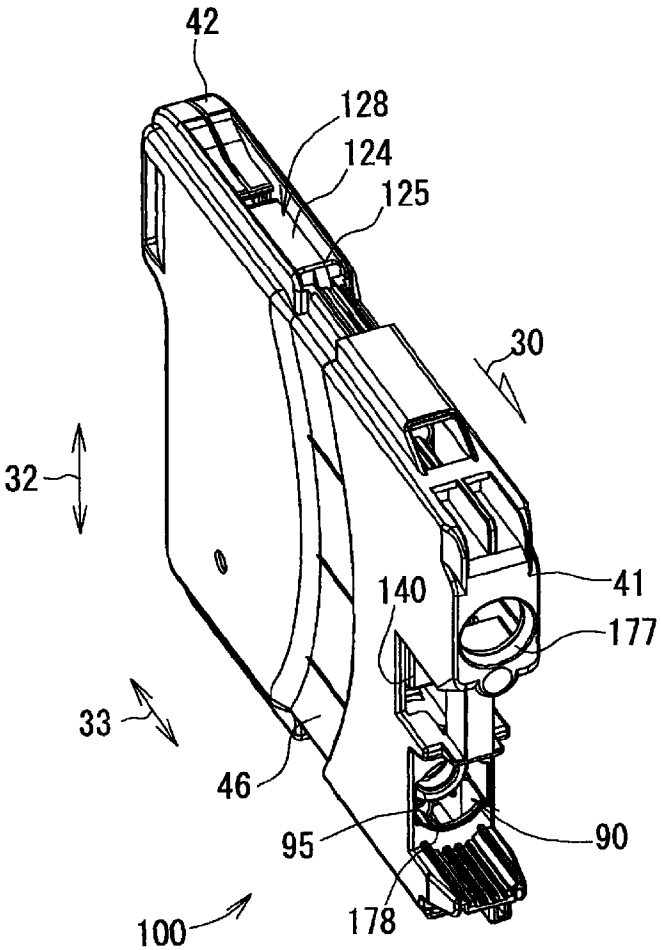
FIG. 2(A) is a perspective view of an ink cartridge of the ink supply system of FIG. 1, in which a slider of the ink cartridge is in a first position.
Figure 3A:
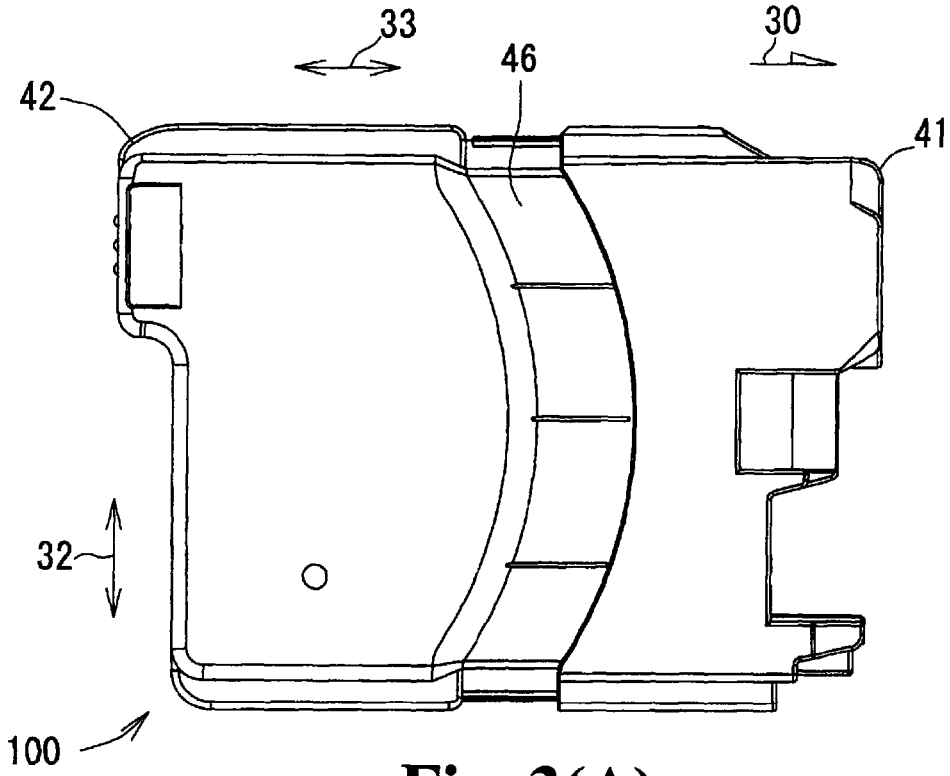
FIG. 3(A) is a side view of the ink cartridge of FIG. 2(A).
Figure 3B:
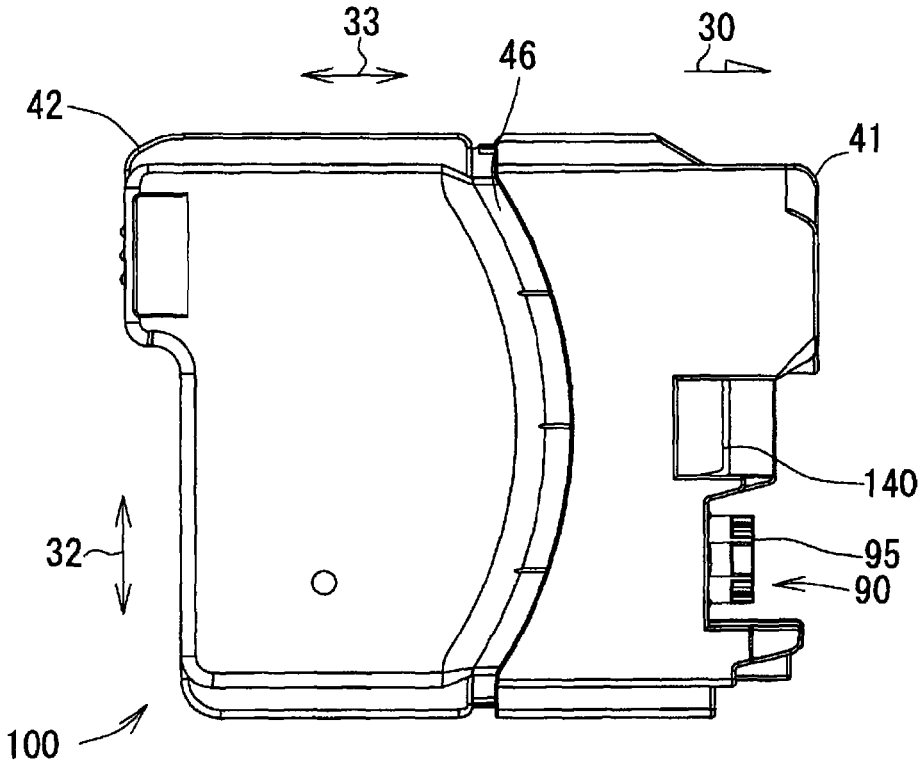
FIG. 3(B) is a side view of the ink cartridge of FIG. 2(B).
Figure 4B:
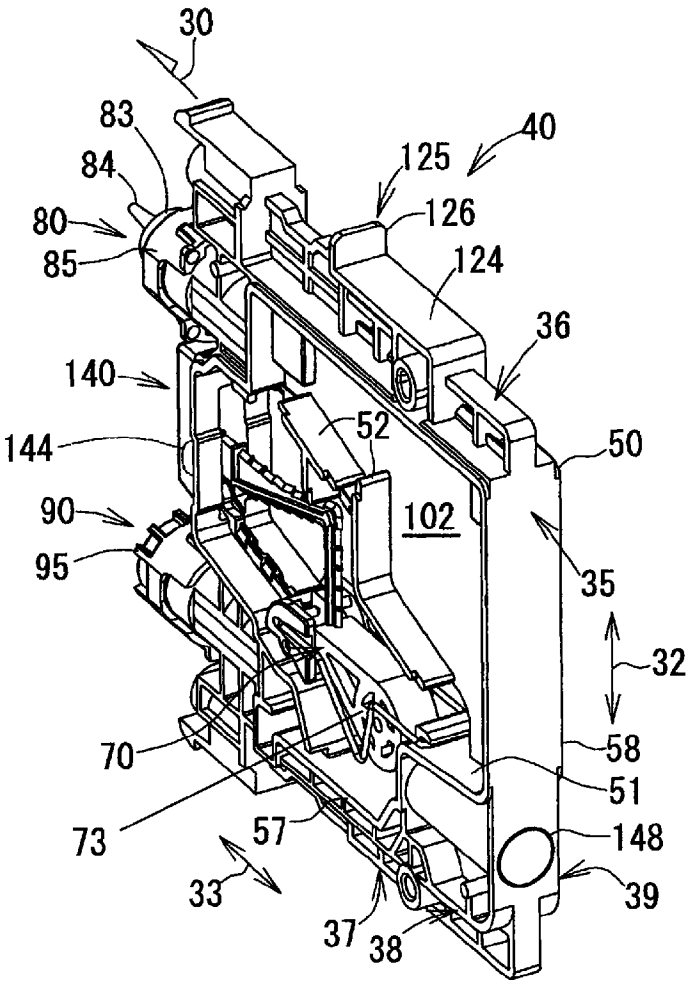
FIG. 4(B) is a rear perspective view of the case of FIG. 4(A).
Figure 4A:
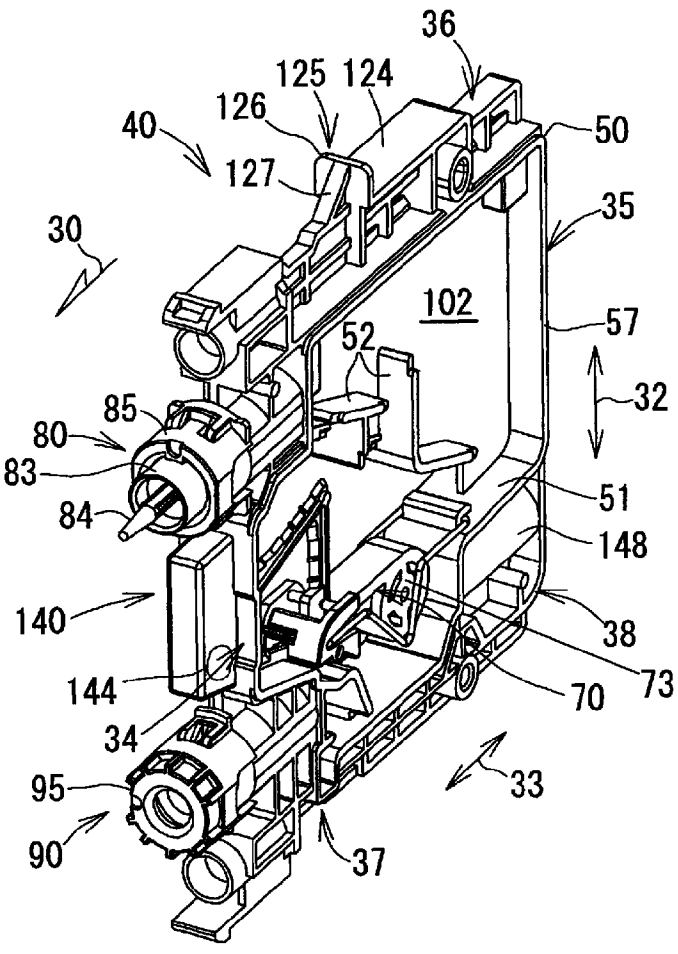
FIG. 4(A) is a front perspective view of a case of the ink cartridge of FIGS. 2(A) and 2(B).

Ink cartridge 100 may comprise a case 40 as shown in FIGS. 4(A) and 4(B), a slider 41, and a case cover 42, as shown in FIGS. 2(A)-3(B). Slider 41 and case cover 42 may substantially define the outer appearance of ink cartridge 100. Slider 41 and case cover 42 may substantially enclose case 40. Each of case 40, slider 41, and case cover 42 may comprise a resin material, such as nylon, polyethylene, polypropylene, or the like.

Referring to FIGS. 4(A) and 4(B), case 40 may comprise a front face 34, a rear face 35 opposite front face 34, a top face 36, a bottom face 37 opposite top face 36, a left side face 38, and a right side face 39 opposite left side face 38. When ink cartridge 100 is inserted into cartridge mounting portion 200, case 40 may be inserted from a front face 34 side. When ink cartridge 100 is mounted to cartridge mounting portion 200, the top face 36 may be positioned above bottom face 37. Each of an area of left side face 38 and an area of right side face 39 may be greater than an area of front face 34, an area of rear face 35, an area of top face 36, and an area of bottom face 37.

Referring to FIGS. 2(A)-3(B), case cover 42 may cover case 40 substantially in its entirety, except for front face 34 and a portion of top face 36. As such, most portions of case 40, in particular, side surfaces 38 and 39, may be protected from damage when an external force is applied to ink cartridge 100.

Slider 41 may be coupled to case 40 via a plurality of coil springs (not shown). Slider 41 may cover front face 34 of case 40 and a front portion 46 of case cover 42, which is positioned adjacent to front face 34 of case 40. Slider 41 may be configured to slide in depth direction 33. In FIGS. 2(A) and 3(A), slider 41 is in a first position along the sliding range in the depth direction 33, which corresponds to when slider 41 is most distant from front face 34 of case 40. In FIGS. 2(B) and 3(B), slider 41 is in a second position along the sliding range, which corresponds to when slider 41 is closest to front face 34 of case 40.

Referring to FIGS. 2(A)-3(B), slider 41 may have openings 177 and 178 formed therethrough. Opening 177 may be aligned with an air introduction valve mechanism 80 in depth direction 33, and opening 178 may be aligned with an ink supply valve mechanism 90 in depth direction 33. Therefore, although slider 41 may be coupled to case 40, air introduction valve mechanism 80 and ink supply valve mechanism 90 may be exposed to the exterior of slider 41 via openings 177 and 178, respectively. When slider 41 slides from the first position to the second position, a cap 95 of ink supply valve mechanism 90 may emerge from an interior of slider 41 to an the exterior of slider 41 via opening 178. When slider 41 slides from the second position to the first position, cap 95 may retract into slider 41.

Referring to FIGS. 4(A) and 4(B), case 40 may comprise a frame 50, an arm 70, air introduction valve mechanism 80, ink supply valve mechanism 90, and a pair of flexible, translucent, e.g., transparent or semi-transparent, films (not shown) attached to frame 50. The pair of films are omitted in FIGS. 4(A) and 4(B).

Frame 50 substantially may define the outer appearance of case 40. Therefore, the six faces 34-39 of case 40 may correspond to six faces of frame 50. Hereinafter, the faces of frame 50 are referred to using the reference numerals that are assigned to the faces of case 40, respectively.

Frame 50 may comprise a translucent material, e.g., a transparent or semi-transparent resin material, such as polyacetal, nylon, polyethylene, and polypropylene, and may be manufactured by injection-molding the resin material.

Frame 50 may comprise an outer peripheral wall 51 and inner walls 52. Outer peripheral wall 51 and inner walls 52 may be integral and may extend between left side face 38 and right side face 39 of frame 50. Outer peripheral wall 51 may have a substantially rectangular profile extending along front face 34, top face 36, rear face 35, and bottom face 37 to form a space therein. As such, openings 57 and 58 may be formed at left side face 38 and right side face 39 of frame 50, respectively. Inner walls 52 may be positioned inside outer peripheral wall 51.

The pair of films may be attached, e.g., welded or bonded with adhesive, to both ends of outer peripheral wall 51 at left side face 38 and right side face 39, respectively, such that openings 57 and 58 may be covered by the pair of films, respectively. Outer peripheral wall 51 and the pair of films may define an ink chamber 102 therein. Ink chamber 102 may be configured to store ink therein. In another embodiment, the frame may be a container having rigid six faces and an ink chamber may be formed in the container.

The pair of films also may be attached, e.g., welded or bonded with adhesive, to both ends of inner walls 52 at left side face 38 and right side face 39, respectively. Because the pair of films are supported by inner walls 52, slack of the pair of films may be prevented. When an external force is applied to ink cartridge 100, such that slider 41 and case cover 42 are bent toward case 40, slider 41 and case 42 may be supported by inner walls 52, and therefore, deformation of slider 41 and case 42 may be prevented.

Frame 50 may comprise a detection portion 140 positioned at front face 34 of frame 50. The amount of ink stored in ink chamber 102 may be observed visually or optically via detection portion 140. Detection portion 140 may be integral with frame 50. Therefore, detection portion 140 may comprise the same material as frame 50, i.e., a translucent material, e.g., a transparent or semi-transparent resin material. Light may pass through detection portion 140.

Detection portion 140 may be positioned between air introduction valve mechanism 80 and ink supply valve mechanism 90, and may extend outward from front face 34 of case 40. Detection portion 140 may have a substantially rectangular, parallelepiped shape, and may comprise five rectangular walls. Detection portion 140 may have an inner space 142 defined by the five rectangular walls of detection portion 140. Inner space 142 may be continuous with ink chamber 102.

When ink cartridge 100 is mounted to cartridge mounting portion 200, detection portion 140 may be positioned in an optical path 183 of an optical sensor 181, e.g., a photo-interrupter, of cartridge mounting portion 200. Detection portion 140 may comprise an irradiation portion 144 positioned at one of the five rectangular walls, which wall may extend in height direction 32, and optical path 183 may intersect irradiation portion 144.

Figure 5:
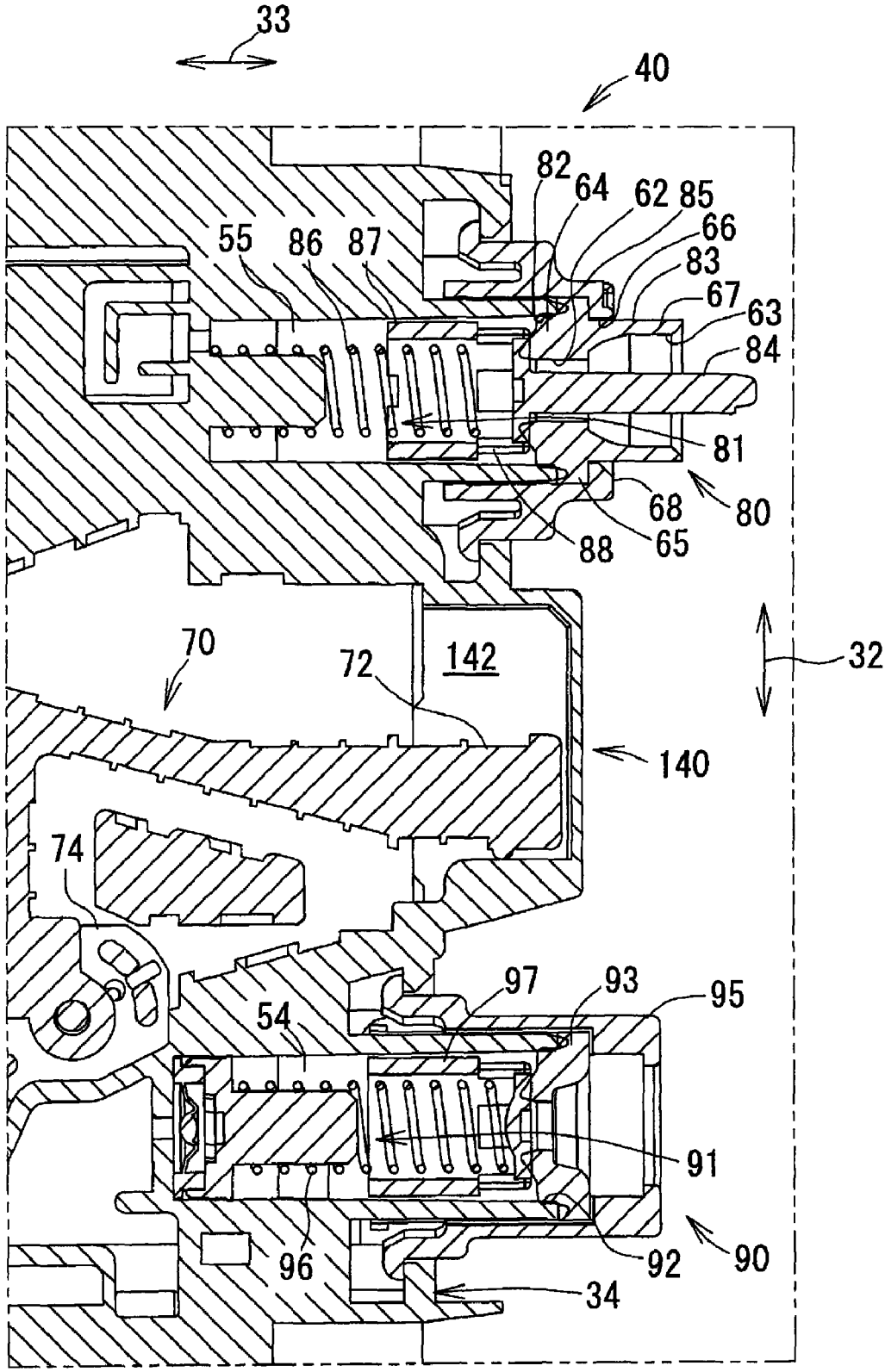
FIG. 5 is a partial, enlarged, cross-sectional view of a front portion of the ink cartridge of FIGS. 2(A) and 2(B).

Referring to FIGS. 4(A)-5, arm 70 may be positioned in ink chamber 102. Arm 70 may comprise an opaque resin material. Arm 70 may be pivotably supported by a rib 74 which may extend from outer peripheral wall 51 into ink chamber 102. Rib 74 may be positioned at the center of frame 50 in width direction 31. Arm 70 may comprise a float portion 73 positioned at one end of arm 70, and arm 70 may comprise an indicator portion 72 positioned at the other end of arm 70, and indicator portion 72 may be positioned in inner space 142. The specific gravity of float portion 73 may be less that the specific gravity of ink stored in ink chamber 102, and therefore, float portion 73 may float on ink. When float portion 73 moves up and down based on the amount of ink stored in ink chamber 102, arm 70 may pivot and indicator portion 72 may move up and down in inner space 142 according to the movement of arm 70. By detecting the position of indicator portion 72 via detection portion 140 with optical sensor 181, it may be determined whether or not a sufficient amount of ink is stored in ink chamber 102.

Referring to FIG. 5, a circular opening 82 may be formed through front face 34 of frame 50 between detection portion 140 and top face 36 of frame 50. A cylindrical air introduction passage 55 may be formed in frame 50, and air introduction passage 55 may be continuous with opening 82. Air introduction passage 55 may extend from opening 82 toward ink chamber 102 in depth direction 33. Air introduction passage 55 may be in fluid communication with ink chamber 102. Air introduction valve mechanism 80 may be positioned partially in air introduction passage 55.

Air introduction valve mechanism 80 may be configured to selectively allow and prevent fluid communication between ink chamber 102 and the exterior of case 40 via air introduction passage 55. Air introduction valve mechanism 80 may comprise a valve 87, a biasing member, e.g., a spring 86, a tube, e.g., a sealing member 83, and a cap 85.

Cap 85 may be attached to the frame, such that sealing member 83 is sandwiched between cap 85 and a portion of frame 50 defining opening 82. Sealing member 87 may comprise an elastic material, such as rubber. Sealing member 87 may have a small-diameter opening 62 and a large-diameter opening 63 formed therein. Small-diameter opening 62 may be continuous with large-diameter opening 63. A diameter of small-diameter opening 62 may be less than a diameter of large-diameter opening 63. Sealing member 83 may have a first end 64 and a second end 67 opposite first end 64. Small-diameter opening 62 may extend from first end 64 of sealing member 83 to large-diameter opening 63, and large-diameter opening 63 may extend from second end 67 of sealing member 83 to small-diameter opening 62. An outer diameter of first end 64 of sealing member 83 may be slightly greater than a diameter of opening 82. First end 64 of sealing member 83 may be fitted into air introduction passage 55 via opening 82, and an outer peripheral surface of first end 64 then may elastically deform and contact an inner surface of air introduction passage 55, such that a reliable seal is provided between the outer peripheral surface of first end 64 of sealing member 83 and the inner surface of air introduction passage 55. Sealing member 83 may comprise a brim 65 at an outer peripheral surface thereof. Brim 65 may contact the portion of frame 50 defining opening 82. The contact between brim 65 and the portion of frame 50 defining opening 82 may prevent sealing member 83 from further entering into air introduction passage 55. The wall of second end 67 of sealing member 83 may be sufficiently thin, such that it may deform when receiving an external force.

Cap 85 may comprise a lid portion 68 having an opening 66 formed therethrough. Sealing member 83 may extend from the interior of cap 85 to the exterior of cap 85 via opening 66, such that second end 67 of sealing member 83 is positioned in the exterior of cap 85. Brim 65 of sealing member 87 may be pressed against the portion of frame 50 defining opening 82 by a portion of cap 85 defining opening 66.

An air introduction port 81 may be formed through opening 66 of cap 85, small-diameter opening 62 of sealing member 83, and large-diameter opening 63 of sealing member 83. Air introduction passage 55 may be configured to be in fluid communication with the exterior of case 40 via air introduction port 81.

Valve 87 may be positioned in air introduction passage 55 and may be configured to slide in depth direction 33, which may be parallel to insertion direction 30. Valve 87 may be configured to slide between a first position in which valve 87 contacts sealing member 83 and covers small-diameter opening 62, and a second position in which valve 87 is separated from sealing member 83 and uncovers small-diameter opening 62. Valve 87 may have a lid 88 and a rod 84. Rod 84 may extend from the center of lid 88 away from air introduction passage 55, e.g., rightward in FIG. 5. Spring 86 may bias valve 87 toward the first position. When valve 87 is in the first position, rod 84 may extend to the exterior of cap 85 and sealing member 83 via air introduction port 81. In another embodiment, spring 86 may be replaced by a sponge.

When no external force is applied to rod 84, lid 88 may remain in the first position while being biased by spring 86. When an external force is applied to rod 84 toward air introduction passage 55 against the biasing force of spring 86, valve 87 may move to the second position. When valve 87 is in the second position, ink chamber 102 may be in fluid communication with the exterior of case 40 via air introduction passage 55 and air introduction port 81, and the pressure in ink chamber 102 may increase and become equal to the atmospheric pressure.

Referring to FIG. 5, a circular opening 92 may be formed through front face 34 of frame 50 between detection portion 140 and bottom face 37 of frame 50. A cylindrical ink supply passage 54 may be formed in frame 50, and ink supply passage 55 may be continuous with opening 92. Ink supply passage 54 may extend from opening 92 toward ink chamber 102 in depth direction 33. Ink supply passage 54 may be in fluid communication with ink chamber 102. Ink supply valve mechanism 90 may be positioned partially in ink supply passage 54.

Ink supply valve mechanism 90 may be configured to selectively allow and prevent fluid communication between ink chamber 102 and the exterior of case 40 via ink supply passage 54. Ink supply valve mechanism 90 may comprise a valve 97, a spring 96, a sealing member 93, and a cap 95.

Cap 95 may be attached to frame 50, such that sealing member 93 is sandwiched between cap 95 and a portion of frame 50 defining opening 92. Sealing member 93 may comprise an elastic material, such as rubber. Each of cap 95 and sealing member 93 may have an opening formed therethrough. An ink supply port 91 may be formed through the openings of cap 95 and sealing member 93. Ink supply passage 54 may be configured to be in fluid communication with the exterior of the case via ink supply port 91.

Valve 97 may be positioned in ink supply passage 54 and may be configured to slide in direction 33, which may be parallel to insertion direction 30. Spring 96 may bias valve 97 toward sealing member 93, such that valve 97 contacts sealing member 93 and covers ink supply port 91.

When no external force is applied to valve 97, valve 97 may be biased by spring 96, such that valve 97 contacts sealing member 93 and covers ink supply port 91. When an external force is applied to valve 97 toward ink supply passage 54 against the biasing force of spring 96, valve 97 may be separated from sealing member 93 and ink supply port 91 is uncovered. When this occurs, ink chamber 102 may be in fluid communication with the exterior of case 40 via ink supply passage 54, and ink stored in ink chamber 102 may be supplied to the exterior of case 40.

Referring to FIGS. 4(A) and 4(B), top face 36 of frame 50 may comprise a platform 124. Platform 124 may extend from an intermediate position of top face 36 toward rear face 35 with respect to depth direction 33, but may not reach rear face 35. Referring to FIGS. 2(A) and 2(B), platform 124 may be exposed to the exterior of case cover 42 via an opening 128 formed through a top face of case cover 42.

Frame 50 may comprise a stopper 125 extending outward from platform 124 in height direction 32. Stopper 125 may be positioned at the front end of platform 124. Stopper 125 may comprise a vertical wall 126 extending from platform 124, and an angle between vertical wall 126 and platform 124 may be about 90 degrees. Vertical wall 126 may have an end positioned opposite from platform 124. Stopper 125 also may comprise a slant rib 127 extending from the end of vertical wall 126 to a particular portion of top face 36, and the particular portion may be positioned closer to front face 34 than platform 124 is positioned to front face 34. An angle between slant rib 127 and vertical wall 126 may be about 45 degrees. When ink cartridge 100 is mounted to cartridge mounting portion 200, stopper 125 may contact a lock lever 230 of cartridge mounting portion 200, and ink cartridge 100 may not be removed from cartridge mounting portion 200.

Figure 6:
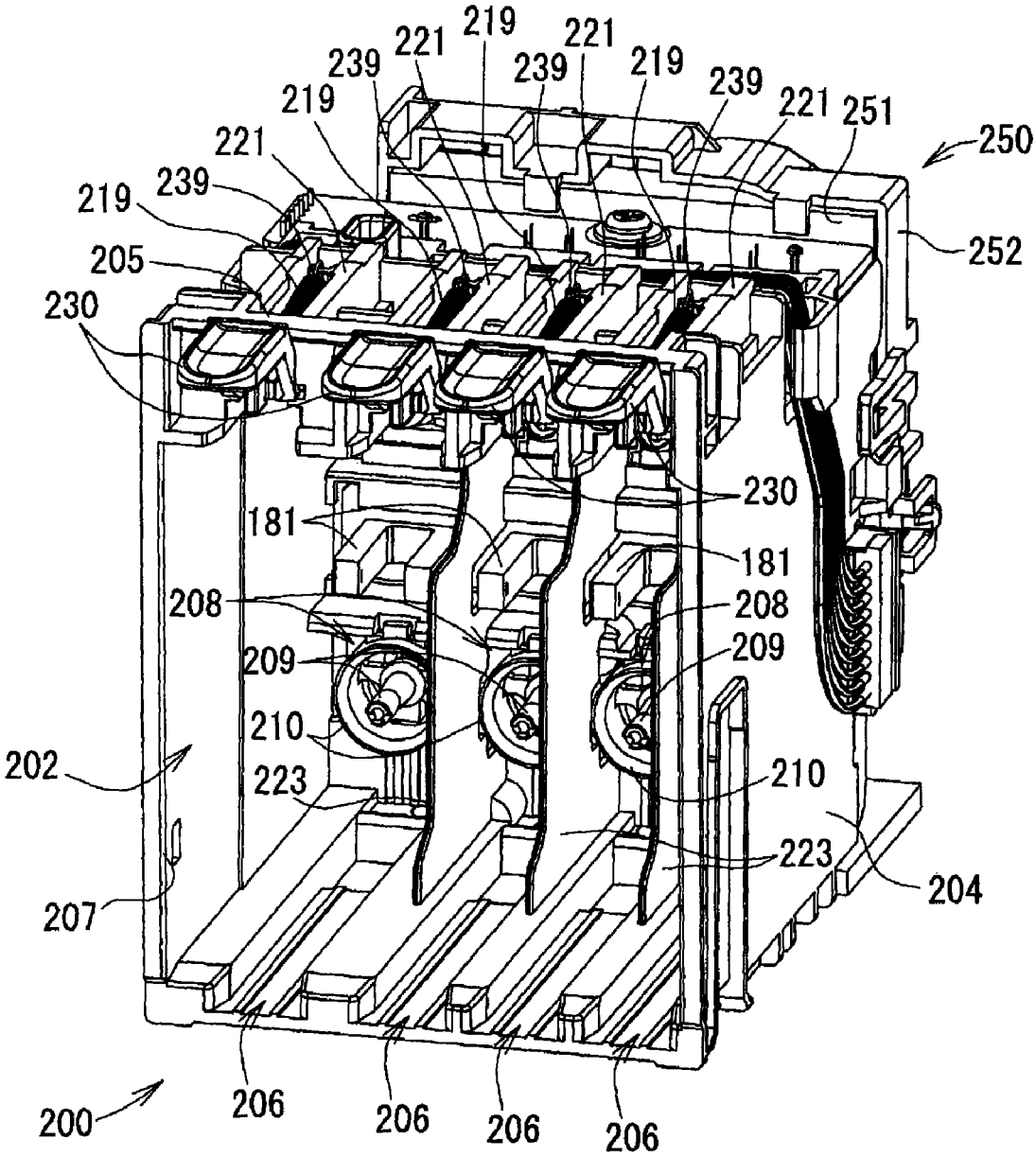
FIG. 6 is a perspective view of a cartridge mounting portion of the ink supply system of FIG. 1.
Figure 7:
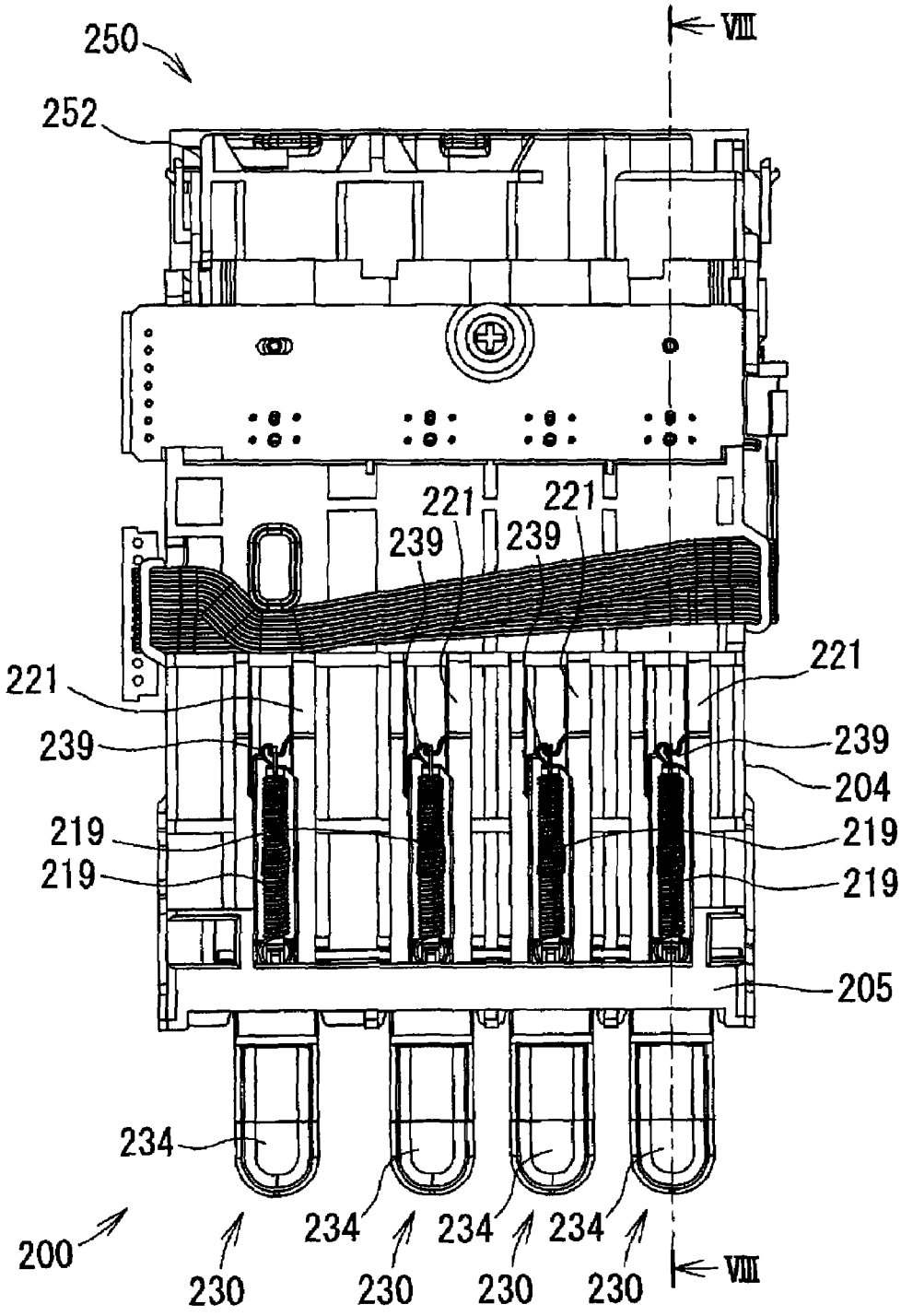
FIG. 7 is a plan view of the cartridge mounting portion of FIG. 6.

Referring to FIG. 6, cartridge mounting portion 200 may comprise a frame 204 having substantially a rectangular, parallelepiped shape. Frame 204 may have a front opening 207 formed therethrough. A cartridge accommodating space 202 may be formed in frame 204, and when ink cartridge 100 is mounted to cartridge mounting portion 200, ink cartridge 100 may be accommodated in cartridge accommodating space 200. Cartridge accommodating space 202 may be configured to accommodate four ink cartridges 100 storing cyan ink, magenta ink, yellow ink, and black ink, respectively.

Figure 8:
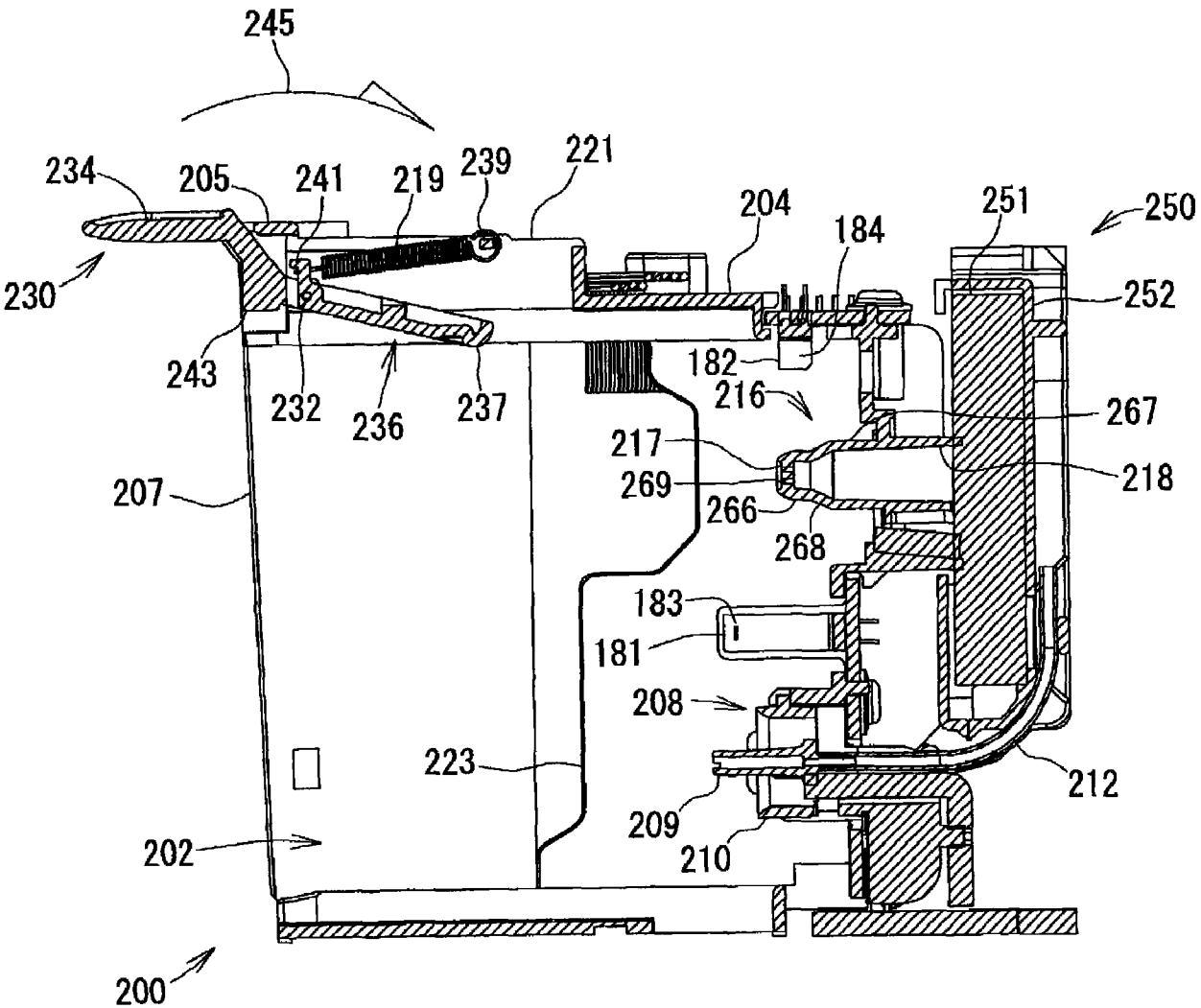
FIG. 8 is a cross-sectional view of the cartridge mounting portion taken along line VIII-VIII in FIG. 7.

Referring to FIGS. 6 and 8, cartridge mounting portion 200 may comprise three plates 223 partitioning cartridge accommodating space 202 into four spaces which are longer in the vertical direction. Four ink cartridges 100 may be accommodated in the respective spaces partitioned by plates 223. Frame 204 may comprise an end surface opposite opening 207. Plates 223 may extend from the end surface of frame 204 toward opening 207. Cartridge mounting portion 200 may have a width in a width direction of cartridge mounting portion 200 and a depth in a depth direction of cartridge mounting portion 200. The depth direction of cartridge mounting portion 200 may extend from opening 207 to the end surface of frame 204, and the width direction of cartridge mounting portion 200 may be perpendicular to the depth direction of cartridge mounting portion 200. Plates 223 may be arranged in the width direction of cartridge mounting portion 200.

Frame 204 may comprise a bottom inner surface, and may have four guide grooves 206 formed in the bottom inner surface thereof. Guide grooves 206 may be configured to smoothly guide ink cartridges 100 relatively deep into cartridge accommodating space 202 when ink cartridges 100 are inserted into cartridge accommodating space 202. Guide grooves 206 may extend straight from opening 207 in the depth direction of cartridge mounting portion 200. Guide grooves 206 may be aligned at a predetermined interval in the width direction of cartridge mounting portion 200. The leftmost guide groove 206 in FIG. 6 may be configured to receive black ink cartridge 100. The left most guide groove 206 may be wider than the other guide grooves 206 in the width direction of cartridge mounting portion 200 because black ink cartridge 100 may be wider in width direction 31 than the other ink cartridges 100. Ink cartridge 100 may be smoothly inserted into cartridge accommodating space 202 in insertion direction 30 while a bottom portion of ink cartridge 100 is guided by the corresponding guide groove 206. When ink cartridge 100 is mounted to cartridge mounting portion 200, width direction 31 may correspond to the width direction of cartridge mounting portion 200, depth direction 33 may correspond to the depth direction of cartridge mounting portion 200, and height direction 31 may correspond to a height direction of cartridge mounting portion 200, which may be perpendicular to each of the width direction and the depth direction of cartridge mounting portion 200.

Referring to FIG. 8, cartridge mounting portion 200 may comprise projections 216 extending from the end surface of frame 204. Projections 216 may be positioned so as to correspond to the respective air introduction valve mechanisms 80 of ink cartridges 100. As shown in FIGS. 2(A) and 2(B), when ink cartridge 100 is mounted to cartridge mounting portion 200, projection 216 may contact and push rod 84 of air introduction valve mechanism 80 via opening 177 of slider 41. In this embodiment, four projections 216 may be provided corresponding to four ink cartridges 100.

Referring again to FIG. 8, projection 216 may extend from the end surface of frame 204 in a direction perpendicular to the end surface of frame 204. Projection 216 may extend in a direction opposite insertion direction 30 of ink cartridge 100. When ink cartridge 100 is inserted into cartridge accommodating space 202, projection 216 may pass through opening 177 of slider 41. The length of projection 216 may be selected such that projection 216 may begin passing through opening 177 before other members positioned at the end surface of frame 204 contact or go into ink cartridge 100 when ink cartridge 100 is inserted into cartridge accommodating space 202. When projection 216 is inserted through opening 177 of slider 41, slider 41 is aligned with respect to frame 204.

Projection 216 may have a substantially cylindrical shape. Projection 216 may extend through the end surface of frame 204. Projection 216 may have a first end positioned in cartridge accommodating space 202 and away from the end surface of frame 204. Projection 216 may have a second end 218 opposite the first end of projection 216, and second end 218 of projection 216 may be positioned in the exterior of frame 204. Projection 216 also may have an inner space formed therein, and the inner space may be open to the exterior of projection 216 at second end 218 of projection 216. The inner space of projection 216 may extend from second end 218 of projection 216 toward the first end of projection 216.

A round recess 217 may be formed at the first end of projection 216. A diameter of recess 217 may be greater than an outer diameter of the end of rod 84 of air introduction valve mechanism 80. A plurality of openings 269 may be formed through the bottom of recess 217. Each opening 269 may be positioned away from the center of recess 217 in a radial direction of recess 217. The inner space of projection 216 may be continuous with openings 269, and the inner space of projection 216 may be in fluid communication with the exterior of projection 216 via openings 269.

Projection 216 may comprise a small-diameter portion 266 and a large-diameter portion 267. Small-diameter portion 266 may comprise the first end of projection 216, and large-diameter portion 267 may be connected to the end surface of frame 204. A slant portion 268 may be formed between small-diameter portion 266 and large-diameter portion 267. An outer diameter of small-diameter portion 266 may be slightly greater than a diameter of large-diameter opening 63 of sealing member 83 of air introduction valve mechanism 80. When ink cartridge 100 is mounted to cartridge mounting portion 200, small-diameter portion 266 may be inserted into large-diameter opening 63 via second end 67 of sealing member 83 and may be fitted into large-diameter opening 63. When this occurs, sealing member 83 elastically may deform and provide a liquid-tight contact with small-diameter portion 266. An outer diameter of large-diameter portion 267 may be greater than an outer diameter of small-diameter portion 266, and may be less than a diameter of opening 177. In this embodiment, sealing member 83 of air introduction valve mechanism 80 may comprise an elastic material. In another embodiment, an elastic member, such as a rubber member, may be attached to an outer surface of small-diameter portion 266, and sealing member 83 may not comprise an elastic material.

Referring still to FIG. 8, cartridge mounting portion 200 may comprise connecting portions 208 positioned at the end surface of frame 204. Connecting portion 208 may be configured to contact the ink supply valve mechanism 90 of ink cartridge 100 when ink cartridge 100 is mounted to cartridge mounting portion 200. In this embodiment, four connecting portions 208 may be provided corresponding to the four ink cartridges 100. In FIG. 6, one of the four connecting portions 208 is not illustrated because the right side wall of frame 204 obstructs the view of one of the four connecting portions 208.

Connecting portion 208 may comprise an ink pipe 209 and a holding portion 210. Ink pipe 209 may comprise a resin link pipe 209 may be connected to a flexible ink tube 212 which may be connected to the recording head of the image forming apparatus.

Holding portion 210 may have a round recess formed therein, and ink pipe 209 may be positioned at the center of the recess of holding portion 210. When ink cartridge 100 is mounted to cartridge mounting portion 200, cap 95 of ink supply valve mechanism 90 may be inserted into the recess of holding portion 210. An outer surface of cap 95 may contact a surface of the recess of holding portion 210, such that cap 95 is securely held in holding portion 210. Therefore, ink supply port 91 accurately may be aligned with respect to ink pipe 209.

Referring to FIG. 8, cartridge mounting portion 200 may comprise optical sensors 181 positioned at the end surface of frame 204. Optical sensors 181 may be positioned to correspond to detection portions 140 of ink cartridges 100, respectively. Optical sensor 181 may be used for detecting whether the amount of ink stored in ink chamber 102 is sufficient. Frame 204 may comprise a top inner surface opposite the bottom inner surface of frame 204. Cartridge mounting portion 200 also may comprise optical sensors 182 positioned at the top inner surface of frame 204 adjacent to the end surface of frame 204. Each one of optical sensor 182 may be used for detecting whether a corresponding one of ink cartridges 100 is mounted to cartridge mounting portion 200. In this embodiment, four sets of optical sensors 181 and 182 may be provided corresponding to four ink cartridges 100. In FIG. 6, one of the four optical sensors 181 is not illustrated because the right side wall of frame 204 obstructs the view of this one of the optical sensors 181.

Each of optical sensors 181 and 182 may comprise a light-emitting element and a light-receiving element. An optical path 183 may be formed between the light-emitting element and the light-receiving element of optical sensor 181. Similarly, an optical path 184 may be formed between the light-emitting element and the light-receiving element of optical sensor 182.

Optical sensor 182 may be positioned above projection 216, projection 216 may be positioned above optical sensor 181, and optical sensor 181 may be positioned above connecting portion 208.

Referring to FIG. 8, cartridge mounting portion 200 may comprise an ink absorbing unit 250 positioned behind frame 204. Ink absorbing unit 250 may comprise an absorber 251 configured to absorb and retain liquid, such as ink, and a support member 252 supporting absorber 251. Absorber 251 may be configured to allow gas, such as air, to pass therethrough. For example, absorber 251 may comprise a sponge or a foam rubber.

Support member 252 may be attached to frame 204, such that absorber 251 covers the inner space of projection 216 at second end 218 of projection 216. Because absorber 251 may be configured to allow gas to pass therethrough, the inner space of projection 216 is in gaseous communication with the exterior of projection 216 via absorber 251.

Referring to FIG. 8, cartridge mounting portion 200 may comprise lock levers 230 positioned adjacent to a top edge of opening 207 of frame 204. Lock lever 230 may be configured to contact ink cartridge 100 positioned in cartridge accommodating space 202 such that ink cartridge 100 does not detach from cartridge mounting portion 200. In this embodiment, four lock levers 230 may be provided corresponding to four ink cartridges 100. With lock lever 230, ink cartridge 100 may be reliably retained in cartridge accommodating space 202.

Lock lever 230 may comprise a support shaft 232. Support shaft 232 may be supported by frame 204 at a position adjacent to a top edge of opening 207 of frame 204, such that lock lever 230 may pivot about support shaft 232.

Lock lever 230 may comprise a push portion 234, an action portion 236, and an engagement portion 243. Engagement portion 243 may extend from support shaft 243 toward the exterior of frame 204, i.e., to the left in FIG. 8, push portion 234 may extend from engagement portion 243 to the exterior of frame 204, i.e., to the left in FIG. 8, and action portion 236 may extend from support shaft 232 toward the end surface of frame 204, i.e., to the right in FIG. 8. Push portion 234 may have a shallow recess formed in its top surface, such that a user readily may apply a downward force to push portion 234 with their finger contacting the recess of push portion 234.

When the user applies the downward force to push portion 234, engagement portion 243 may move into cartridge accommodating space 202 to a position in which a bottom portion of engagement portion 243 may contact a top portion of ink cartridge 100.

Action portion 236 may comprise a contact portion 237 positioned at an end of action portion 236 opposite from support shaft 232. Contact portion 237 may be configured to contact stopper 125 of ink cartridge 100. A bottom portion of contact portion 237 may be curved. A portion of action portion 236 between support shaft 232 and contact portion 237 may be a substantially straight portion.

Referring to FIG. 8, cartridge mounting portion 200 may comprise pull springs 219 positioned above action portions 236 of lock levers 230, respectively. One end of pull spring 219 may be attached to frame 204 above contact portion 237. More specifically, frame 204 may comprise a flat plate 221 extending upward from a top surface of frame 204, and a hook portion 239 extending from plate 221 horizontally in the width direction of cartridge mounting portion 200. The one end of pull spring 219 may hook over hook portion 239, and the other end of pull spring 219 may hook over an L-shaped hook portion 241 extending upward from support shaft 232. The position of hook portion 241 may be slightly lower than the position of hook portion 239. Pull spring 219 may hook over hook portions 239 and 241 while pull spring 219 is expanded from its original length, such that pull spring 219 attempts to contract to its original length. Therefore, lock lever 230 may receive a force from pull spring 219, such that lock lever 230 may pivot in a direction 245 in FIG. 8, i.e., clockwise direction in FIG. 8. Frame 204 may comprise a stopper 205. The pivotal movement of lock lever 230 caused by pull spring 219 may be stopped when lock lever 230 reaches stopper 205. When no external force is applied to push portion 234, lock lever 230 may remain in a position in which lock lever 230 contacts stopper 205. When lock lever 230 is in the position in which lock lever 230 contacts stopper 205, push portion 234 may extend horizontally, and contact portion 237 may contact stopper 125 of ink cartridge 100.

Figure 9:
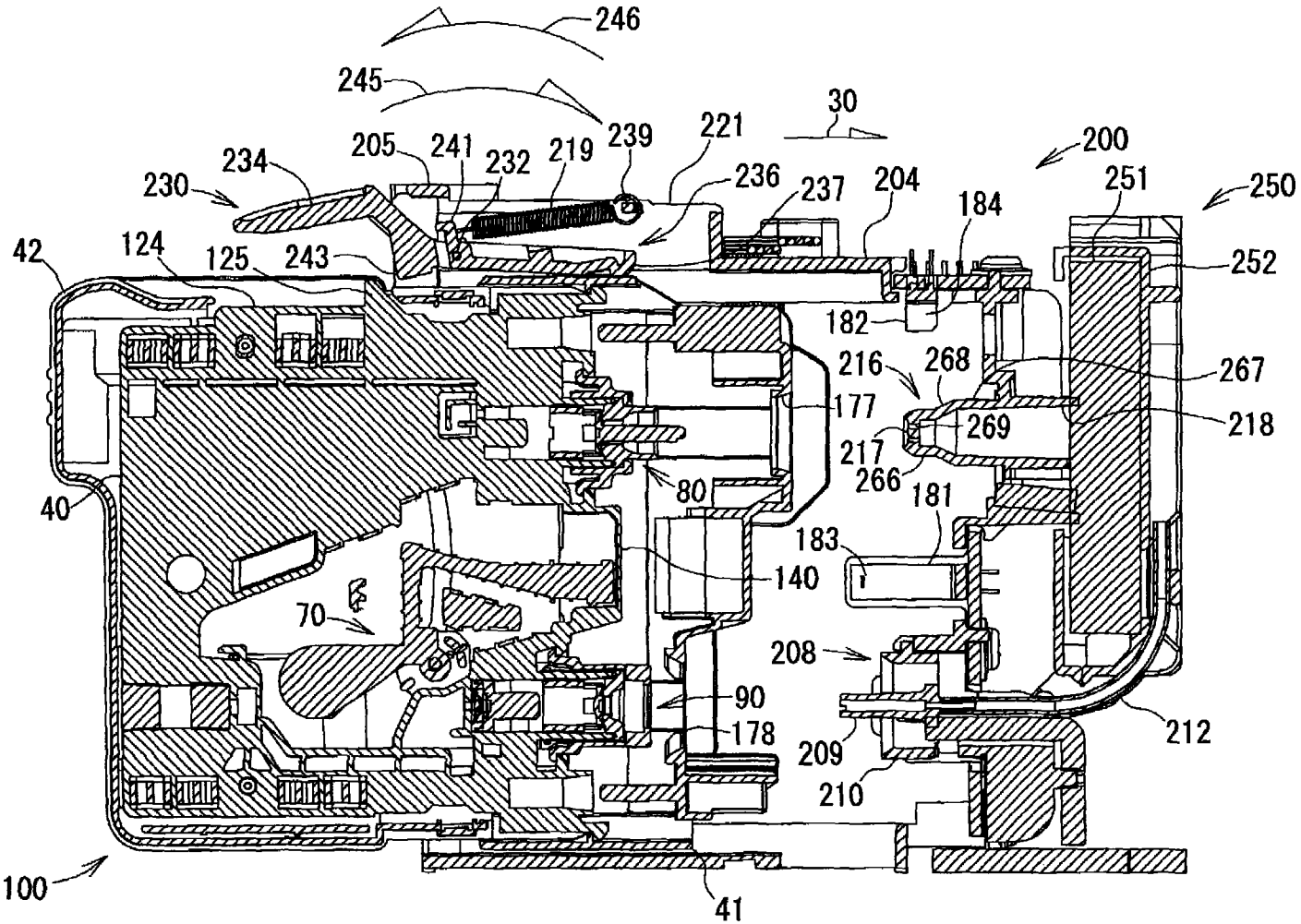
FIG. 9 is a cross-sectional view of the ink cartridge of FIGS. 2(A) and 2(B) and the cartridge mounting portion of FIG. 6, in which the ink cartridge is partially inserted in the cartridge mounting portion, and a spring of an air introduction valve mechanism of the ink cartridge and a spring of an ink supply valve mechanism of the ink cartridge are omitted.
Figure 10:
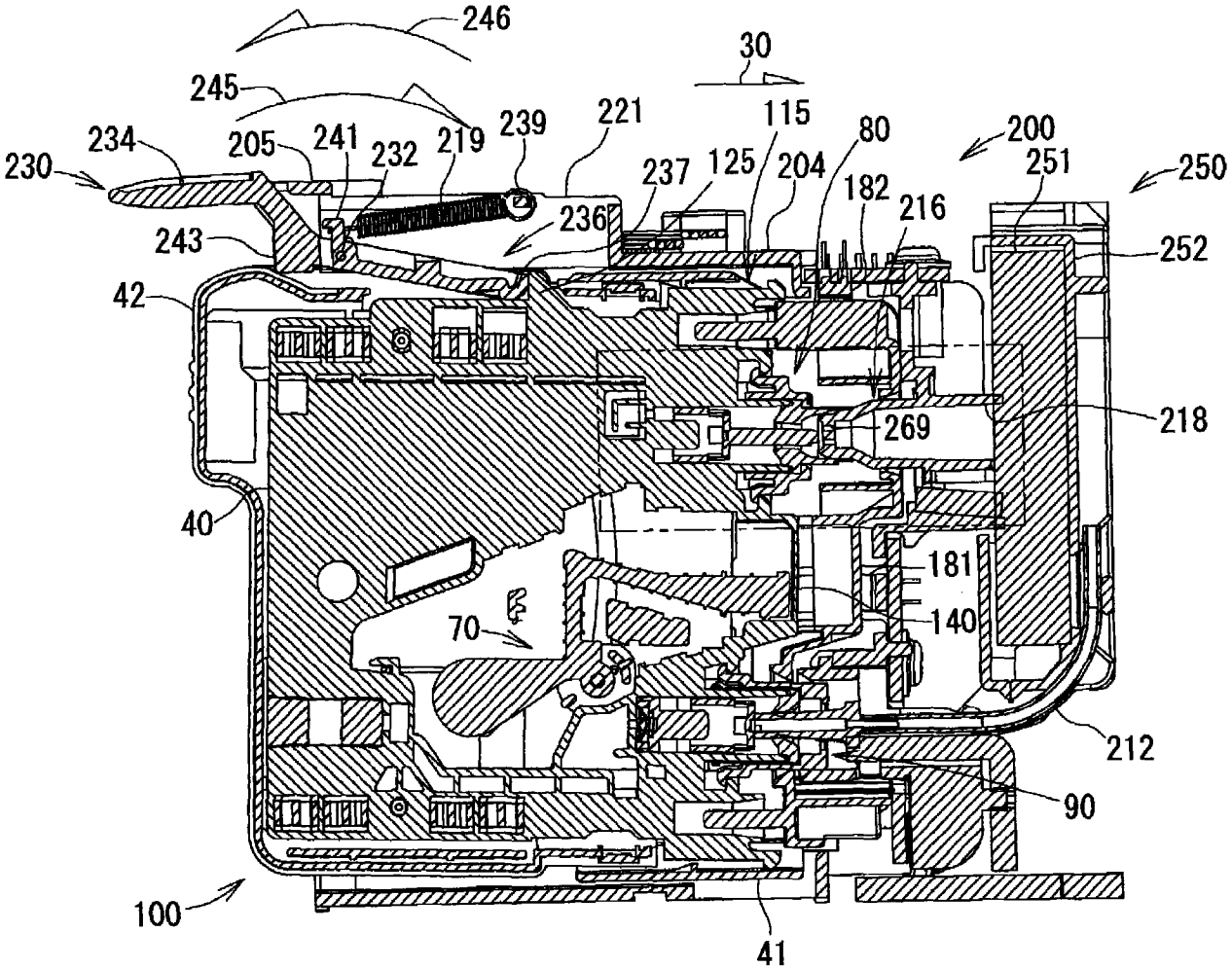
FIG. 10 is a cross-sectional view of the ink cartridge of FIGS. 2(A) and 2(B) and the cartridge mounting portion of FIG. 6, in which the ink cartridge is inserted in the cartridge mounting portion and is mounted to the cartridge mounting portion, and the spring of an air introduction valve mechanism of the ink cartridge and the spring of an ink supply valve mechanism of the ink cartridge are omitted.
Figure 11:
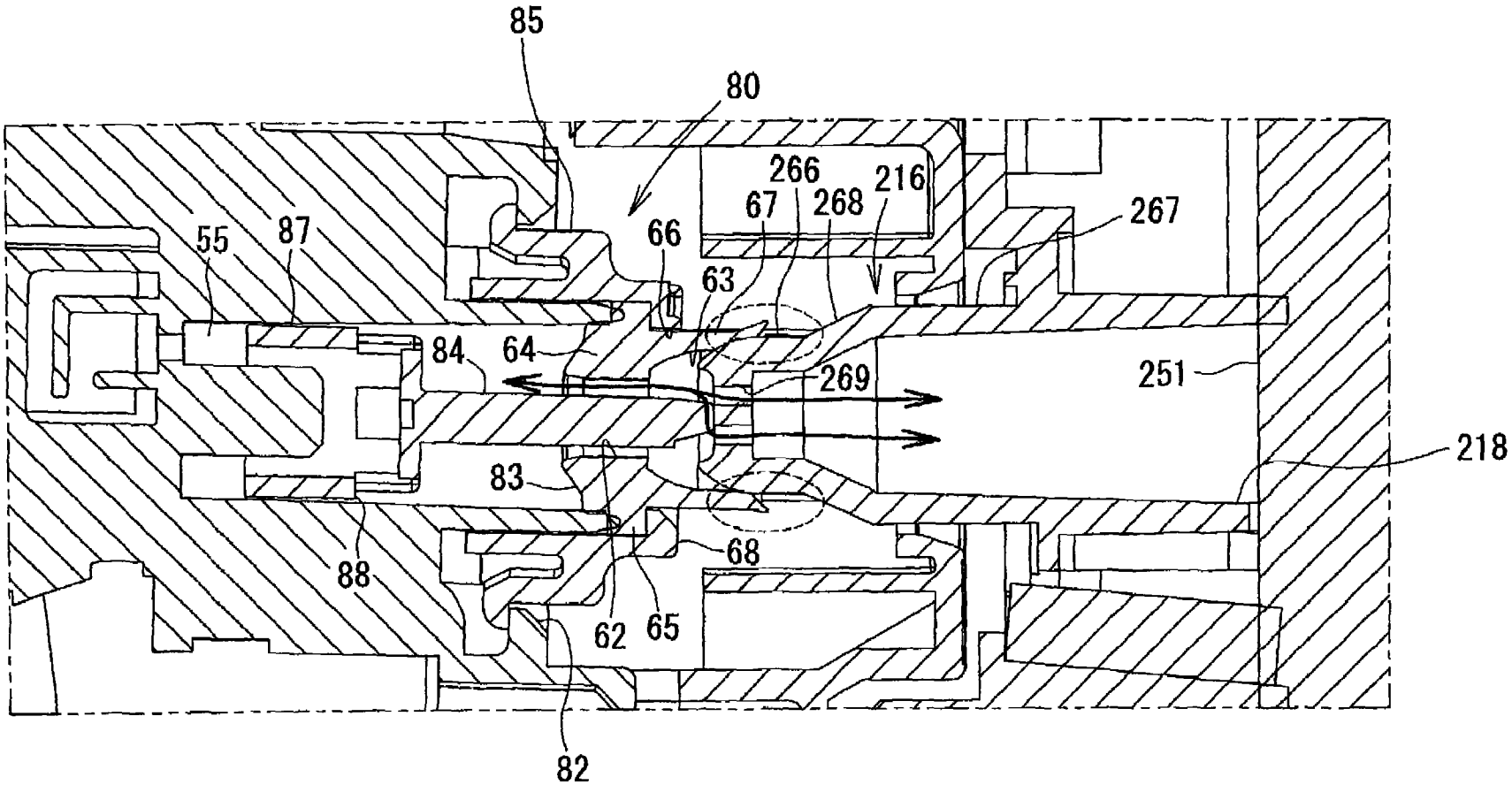
FIG. 11 is an enlarged, cross-sectional view of the dashed line area of FIG. 10 depicting an air introduction valve mechanism and its surrounding components.

Referring to FIGS. 9-11, a method of mounting ink cartridge 100 to cartridge mounting portion 200 is described. Referring to FIG. 9, when ink cartridge 100 is inserted into cartridge accommodating space 202 in insertion direction 30 via opening 207 of frame 204, a top-front end of ink cartridge 100 may contact contact portion 237 of lock lever 230. When this occurs, contact portion 237 may be pushed up by ink cartridge 100. As a result, lock lever 230 may pivot in a direction 246 in FIG. 9, i.e., counterclockwise direction in FIG. 9, against the pulling force of pull spring 219, and push portion 234 may slightly incline downward. As such, the position of push portion 234 may change from a position in which push portion 234 extends horizontally to a position in which push portion 234 is inclined.

When ink cartridge 100 is inserted further into cartridge accommodating space 202, small-diameter portion 266 of projection 216 may be inserted into opening 177 of slider 41. When ink cartridge 100 is inserted further, slant portion 268 and large-diameter portion 267 of projection 216 sequentially may be inserted into opening 177.

When ink cartridge 100 is inserted further, a top end of slider 41 may intersect optical path 184 of optical sensor 182, whereby optical sensor 182 detects slider 41. Then, a front surface of slider 41 may contact the end surface of frame 204.

When ink cartridge 100 is pushed in insertion direction 30 while slider 41 contacts the end surface of frame 204, coil springs (not shown) sandwiched between slider 41 and case 40 may be compressed. As a result, only case 40 may move in the insertion direction 30 while slider 41 is stationary with respect to frame 204, e.g., case 40 may move closer to slider 41. For example, as shown in FIGS. 2(A) and 2(B), slider 41 may move from the first position to the second position.

Referring to FIGS. 10 and 11, when case 40 moves to a position closest to slider 41, i.e., when case 40 is inserted deepest into cartridge accommodating space 202, rod 84 may contact the first end of projection 216. When this occurs, the end of rod 84 may move into recess 217 of projection 216, and reliably may secured in recess 217.

When rod 84 receives a force from projection 216, rod 84 may move and lid 88 may separate from sealing member 83. As a result, air introduction port 81 may be uncovered and the pressure in ink chamber 102 may be increased to be equal to atmospheric pressure. When rod 84 moves further, small-diameter portion 266 of projection 216 may be inserted into large-diameter opening 63 of sealing member 83. When this occurs, sealing member 83 may elastically deform to provide a liquid tight contact with small-diameter portion 266, as indicated by broken lines in FIG. 11. As such, a reliable seal may be provided between sealing member 83 and small-diameter portion 266. Air introduction port 81 may be in gaseous communication with the atmosphere via openings 269, inner space of projection 216, and absorber 251.

When case 40 moves to the position closest to slider 41, cap 95 of ink supply valve mechanism 90 may emerge from slider 41 via opening 178 to the exterior of slider 41, and ink pipe 209 may be inserted into ink supply port 91. Ink pipe 209 may contact and push valve 97, and valve 97 may separate from sealing member 93. As a result, ink stored in ink chamber 102 may be supplied to the recording head of the image forming apparatus via ink pipe 209 and ink tube 212. Moreover, detection portion 140 may intersect with optical path 183 of optical sensor 181. As a result, irradiation portion 144 of detection portion 140 may be irradiated with light emitted from the light-emitting element of optical sensor 181.

When ink cartridge 100 is inserted into cartridge accommodating space 202, contact portion 237 of lock lever 230 may move toward the rear side of ink cartridge 100 while contact portion 237 slides on a top portion of ink cartridge 100 to slant rib 127. When case 40 moves to the position closest to slider 41, contact portion 237 may move over stopper 125. When this occurs, action portion 236 may be pulled by pull spring 219, and may pivot in direction 245, such that contact portion 237 moves onto platform 124. As a result, contact portion 237 may contact the stopper 125. This may prevent case 40 from moving backward due to the pushing force of coil springs (not shown) sandwiched between case 40 and slider 41. Ink cartridge 100 thus may remain in cartridge mounting portion 200.

As described above, when ink cartridge 100 is mounted to cartridge mounting portion 200, small-diameter portion 266 of projection 216 may be inserted and fitted into large-diameter opening 63 of sealing member 83. When this occurs, sealing member 83 elastically may deform to provide a liquid tight contact with small-diameter portion 266, i.e., without a gap therebetween. As such, a reliable seal may be provided between sealing member 83 and small-diameter portion 266. Therefore, even if the image forming apparatus is tilted or is positioned up side down while ink cartridge 100 is mounted to cartridge mounting portion 200 of the image forming apparatus, ink may not leak from a portion of ink cartridge 100 adjacent to air introduction port 81. Even if ink flows into air introduction port 81, such ink may flow via the inner space of projection 216 to absorber 251, and may be absorbed and retained by absorber 251. This may prevent ink from smearing the interior of the image forming apparatus.

While the invention has been described in connection with various exemplary structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. An ink supply system comprising:

an ink cartridge comprising:

an ink chamber configured to store ink;

a tube having a first opening and a second opening formed therein, wherein the second opening is continuous with the first opening, the first opening extends from a first end of the tube, and the second opening extends from a second end of the tube opposite the first end of the tube, wherein the first opening is configured to be in fluid communication with the ink chamber via the first end of the tube, and wherein the second opening is configured to be in fluid communication with an exterior of the tube via the second end of the tube; and a valve configured to move between a first position in which the valve covers the first opening and a second position in which the valve uncovers the first opening; and a cartridge mounting portion configured to receive the ink cartridge, wherein the cartridge mounting portion comprises a projection configured to be inserted into the second opening of the tube via the second end of the tube when the ink cartridge is mounted to the cartridge mounting portion, and a diameter of the second opening is less than an outer diameter of the projection.

2. The ink supply system of claim 1, wherein the tube comprises an elastic material.

3. The ink supply system of claim 2, wherein the tube is configured to elastically deform and to contact the projection when the projection is inserted into the second opening of the tube.

4. The ink supply system of claim 1, wherein the projection comprises a first end and a second end opposite the first end of the projection, and the first end of the projection is configured to be inserted into the second opening of the tube, wherein the projection has an inner space formed therein and a third opening formed through the first end of the projection, wherein the inner space is open to an exterior of the projection at the second end of the projection, and the inner space is in fluid communication with the exterior of the projection via the third opening.

5. The ink supply system of claim 4, further comprising an absorber positioned at the second end of the projection, wherein the absorber is configured to absorb a liquid.

6. The ink supply system of claim 1, further comprising:

a biasing member configured to bias the valve toward the first position, wherein the projection is configured to contact and to move the valve toward the second position against a biasing force of the biasing member when the ink cartridge is mounted to the cartridge mounting portion.

7. The ink supply system of claim 6, wherein the valve comprises a lid and a rod extending from the lid, and the projection is configured to contact and to move the rod when the ink cartridge is mounted to the cartridge mounting portion.

8. The ink supply system of claim 1, wherein a diameter of the first opening is less than the diameter of the second opening.

9. An ink supply system comprising:

an ink cartridge comprising:

an ink chamber configured to store ink; and a tube having an opening formed therein, wherein the opening extends from a first end of the tube to a second end of the tube opposite the first end of the tube, wherein the opening is configured to be in fluid communication with the ink chamber via the first end of the tube, and to be in fluid communication with an exterior of the ink cartridge via the second end of the tube; and a cartridge mounting portion configured to receive the ink cartridge, wherein the cartridge mounting portion comprises a projection configured to be inserted into the opening of the tube via the second end of the tube when the ink cartridge is mounted to the cartridge mounting portion, and wherein the projection includes an inner space formed therein, a recessed portion formed at a distal end of the projection, and one or more third openings formed through the distal end of the projection such that the inner space is in fluid communication with an exterior of the projection via the one or more third openings, the one or more third openings being disposed a radial distance from a central portion of the recessed portion such that a rod of a valve can be received at the central portion of the recessed portion without blocking the one or more third openings.

10. The ink supply system of claim 9, wherein the tube comprises an elastic material.

11. The ink supply system of claim 10, wherein the tube is configured to elastically deform and to contact the projection when the projection is inserted into the opening of the tube.

12. The ink supply system of claim 9, wherein the projection comprises a base end opposite the distal end of the projection, the distal end of the projection is configured to be inserted into the opening of the tube.

13. The ink supply system of claim 12, further comprising an absorber positioned at the base end of the projection, wherein the absorber is configured to absorb a liquid.

14. The ink supply system of claim 9, further comprising:

a valve configured to move between a first position in which the valve covers the opening of the tube and a second position in which the valve uncovers the opening of the tube; and a biasing member configured to bias the valve toward the first position, wherein the projection is configured to contact and to move the valve toward the second position against a biasing force of the biasing member when the ink cartridge is mounted to the cartridge mounting portion.

15. The ink supply system of claim 14, wherein the valve comprises a lid and the rod, the rod extending from the lid, and the projection is configured to contact and to move the rod when the ink cartridge is mounted to the cartridge mounting portion.

* * * * *